United States Patent [19]

Kugisawa

[11] 3,982,461

[45] Sept. 28, 1976

[54] MUSICAL-TONE SIGNAL FORMING APPARATUS FOR ELECTRONIC MUSICAL INSTRUMENT

[75] Inventor: Toshio Kugisawa, Hamamatsu, Japan

[73] Assignee: Kabushiki Kaisha Kawai Gakki Seisakusho, Hamamatsu, Japan

[22] Filed: June 5, 1975

[21] Appl. No.: 584,368

[30] Foreign Application Priority Data

June 6, 1974 Japan ..... 49-64381

[52] U.S. Cl. ..... 84/1.03; 84/1.28

[51] Int. Cl.[2] ..... G10F 1/00

[58] Field of Search ..... 84/1.01, 1.03, 1.11, 84/1.13, 1.19, 1.22, 1.26, 1.28

[56] References Cited

UNITED STATES PATENTS

| | | | |
|---|---|---|---|
| 3,515,792 | 6/1910 | Deutsch | 84/1.28 |
| 3,743,755 | 7/1973 | Watson | 84/1.03 |
| 3,763,364 | 10/1973 | Deutsch | 84/1.03 |
| 3,809,786 | 5/1974 | Deutsch | 84/1.03 |
| 3,844,379 | 10/1974 | Tomisawa et al. | 84/1.03 |
| 3,854,365 | 12/1974 | Tomisawa | 84/1.03 |

*Primary Examiner*—L. T. Hix
*Assistant Examiner*—Vit W. Miska
*Attorney, Agent, or Firm*—Haseltine, Lake & Waters

[57] ABSTRACT

A musical-tone signal forming apparatus is provided for an electronic musical instrument. The apparatus comprises a musical-tone wave form setting circuit in which at least one cycle of a musical-tone wave form is repeatedly subjected to sampling at n points and the amplitude at each sampling point is compared with the amplitude at the preceeding sampling point. An increase, equal or decrease signal is generated in the form of a digital signal to indicate the relationship determined. An envelope setting circuit is provided in which an envelope of a desired musical-tone is subjected to sampling at m point and the analog amount at each sampling point is generated sequentially as a digital signal corresponding thereto. A pulse generating circuit whereby a pulse signal having a number corresponding to the digital signal value produced by the envelope setting circuit is repeatedly generated is employed. Also employed is a distribution circuit including addition and subtraction output terminals in which the output signals of the pulse generating circuit are distributed either to the addition output terminal or the subtraction output terminal according to the digital signals produced by the musical-tone wave form setting circuit. There is also used an up-down counter in which output signals of the addition output signal and the subtraction output terminal are respectively added or subtracted. A D-A converter is provided in which digital signals generated by the up-down counter are converted into analog signals.

6 Claims, 14 Drawing Figures

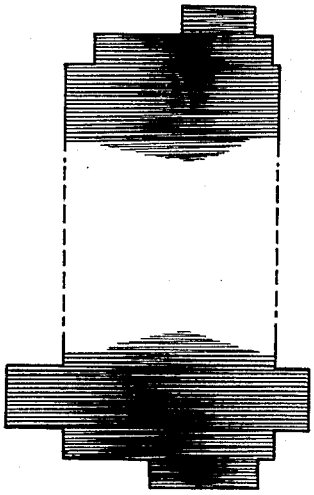
FIG. 5
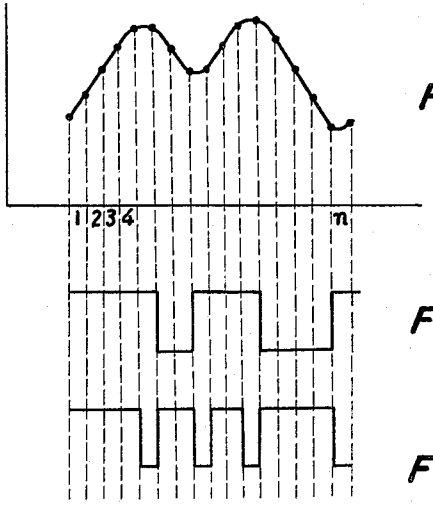
FIG. 2(C)
FIG. 2(A)
FIG. 2(B)
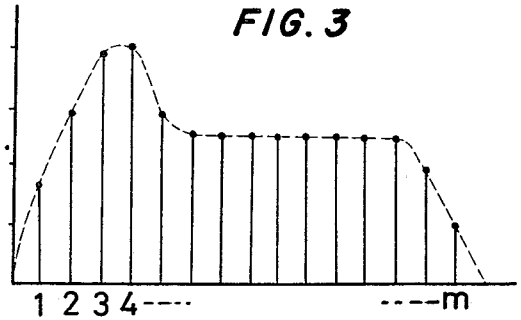
FIG. 3

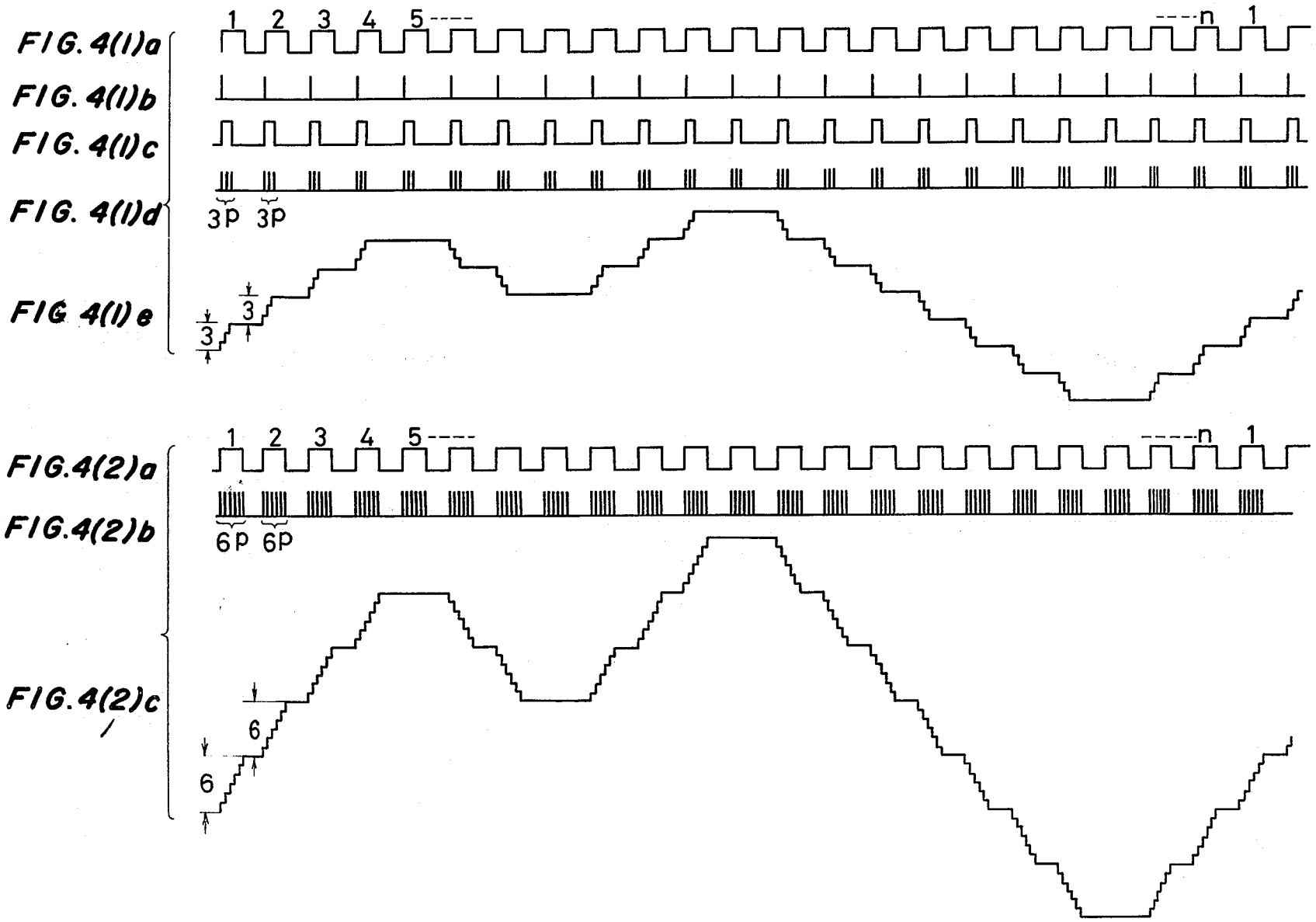
1
2
3
4
5
n
3p
3
6p
6
FIG. 4(1)a
FIG. 4(1)b
FIG. 4(1)c
FIG. 4(1)d
FIG 4(1) e
FIG.4(2)a
FIG.4(2)b
FIG.4(2)c

MUSICAL-TONE SIGNAL FORMING APPARATUS FOR ELECTRONIC MUSICAL INSTRUMENT

FIELD OF THE INVENTION

This invention relates to musical-tone signal forming apparatus for electronic musical instruments.

BACKGROUND

In known apparatus for forming a musical-tone signal for electronic musical instruments, a musical-tone-signal waveform is formed and is passed through an envelope circuit for forming a musical-tone signal having a particular envelope. This envelope circuit generally requires a large-capacity condenser and therefore the circuit must be of large size. Furthermore, the available envelope is limited to a particular range because of the necessity of limiting of the capacity, so that it is generally impossible to form many of the envelopes characterizing various kinds of natural musical instruments or to form other envelopes of original design.

SUMMARY OF THE INVENTION

This invention has as an object the provision of an apparatus free from the above-mentioned defects.

According to the invention, there is provided a musical-tone waveform setting means whereby at least one cycle of a musical-tone waveform is repeatedly subjected to sampling at n points and the amplitude thereof at each sampling point is compared with the amplitude thereof at the next preceding sampling point and INCREASE equal or DECREASE signals are generated as digital signals. Further employed is an envelope setting means whereby an envelope of a musical tone is subjected to sampling at m points and an analogue amount at each sampling point is generated in sequence as a digital signal corresponding thereto. Also used are a pulse generating means whereby a pulse signal of which the pulse number corresponds to the digital signal value of the envelope setting means is repeatedly generated, a distribution means whereby output signals of the pulse generating means are distributed to either an addition output terminal or a subtraction output terminal according to the digital signals of the musical-tone waveform setting means, an up-down counter means whereby output signals of the addition output terminal and the subtraction output terminal are added or subtracted, and a D-A converter means whereby digital signals generated in order from the up-down counter means are converted into analogue signals.

BRIEF DESCRIPTION OF DRAWING

One embodiment of the invention will next be explained with reference to the accompanying drawing in which:

FIG. 2 (C) is a diagram showing a musical tone waveform previously imagined, FIG. 3 is a diagram showing a desired envelope, FIGS. 4 (1) *a—e* and 4 (2) *a–c* show output signals at respective parts of the circuit; and FIG. 5 is a diagram showing a musical-tone signal obtained by apparatus of this invention.

DETAILED DESCRIPTION

Figure 1:
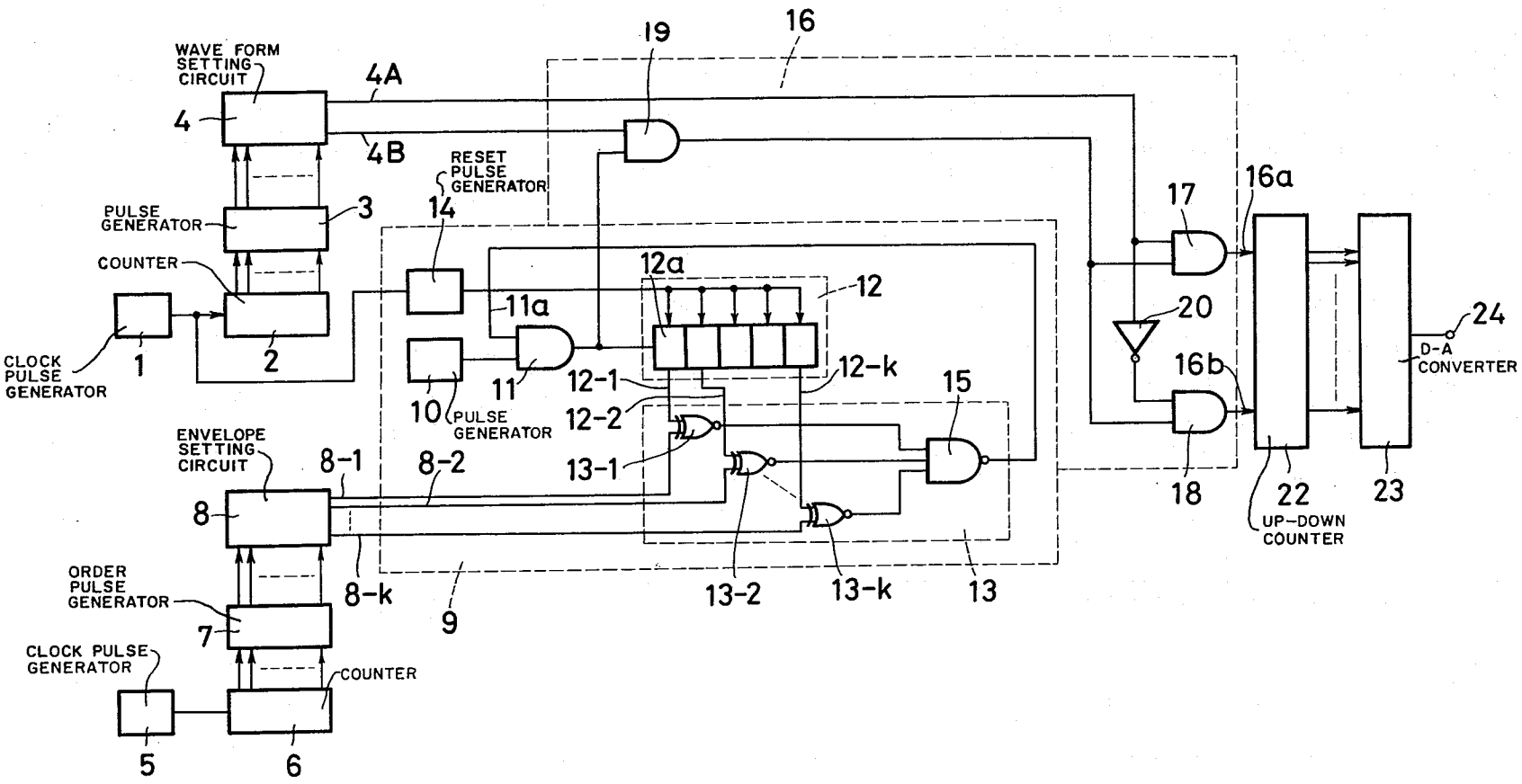
FIG. 1 is a block diagram showing an example of a wave forming apparatus in accordance with one embodiment of the invention, FIGS. 2(A) and (B) are diagrams showing an output signal of a musical-tone waveform setting means.

In FIG. 1 circuit 1 is a clock pulse generator or which generates a clock-pulse signal of a frequency corresponding to the frequency of a musical-scale tone. An output terminal thereof is connected through a first counter 2 and an order pulse generator 3 to a musical-tone waveform setting circuit 4.

The musical tone waveform setting device 4 comprises a matrix circuit having n input terminals connected to output terminals 1 - n of the order pulse generator 3, two output terminals 4A and 4B and n sampling parts. Each of the sampling parts comprises two setting points. At each sampling point of a musical-tone waveform (FIG. 2 (C)), which is desired to be finally obtained, the amplitude is compared with the amplitude thereof at the preceding sampling point. An "INCREASE" signal is generated when the amplitude is larger than the preceding amplitude, an "EQUAL" signal is generated when the amplitudes are equal, or "DECREASE" signal is generated when the amplitude is smaller. There can be obtained at the output terminals 4A and 4B a corresponding signal according to the following table:

| | 4A | 4B |
|---|---|---|
| INCREASE | 1 | 1 |
| DECREASE | 1 | 1 |
| EQUAL | 0 | 0 |

If, the setting points at each sampling point are set according to a desired waveform as shown, for instance, in FIG. 2 (C), there are obtained at the output terminals 4A and 4B output signals as shown in FIGS. 2 (A) and (B) by the order pulses applied, in sequence, to the input terminals of the musical-tone waveform setting device 4.

Circuit 5 is a clock pulse generator for envelope forming. An output terminal thereof is connected through a second counter 6 and an order pulse generator 7 to an envelope setting circuit 8. The envelope setting circuit 8 comprises a matrix circuit having *m* input terminals connected to output terminals 1-*m* of the order pulse generator 7, *k* output terminals and *m* sampling parts. Each sampling part comprises *k* setting points and is so arranged that an analogue amount at each sampling point of an envelope (FIG. 3), which is desired to be finally obtained, is converted into a digital signal of the binary scale of *k* bits. By a setting of each sampling part, there can be obtained in order, at the *k* output terminals, a digial signal of the binary scale of *k* bits by the order pulses applied, in sequence, to each input terminal of the envelope setting device 8. As for a technique similar to the above, see, for instance, U.S. Pat. No. 3,515,792.

Circuit 9 is a pulse generating circuit whereby a pulse signal, the pulse number of which corresponds to the digital signal value of the envelope setting circuit 8, is repeatedly generated. Circuit 9 comprises a high-speed pulse generator or oscillator 10 which generates a pulse signal of a frequency higher than the oscillation frequency of the clock-pulse generator 1. Circuit 9 also includes a counter 12 connected to an output terminal of pulse generator 10 through a gate circuit 11, and a coincidence signal generator 13 which generates a coincidence signal when the signal obtained at output terminals 12-1, 12-2 . . . 12-*k* of the counter 12 and a signal obtained at output terminals 8-1, 8-2 . . . **8-*k* of the envelope setting circuit 8 coincide with one another. Also included is a reset pulse generator 14 which generates a separate sharp pulse corresponding to the front edge, that is the rising portion of each clock pulse generated from the clock pulse generator 1.**

The output terminal of the reset pulse generator 14 is connected to the reset terminal of the counter means 12 and the output terminal of the coincidence signal generator 13 is connected to control terminal **11*a* of the gate circuit 11. The counter 12** comprises *k* flip-flop circuits **12*a*. Output terminals 12-1, 12-2 . . . 12-*k* are led out from flip-flop circuits 12*a*. The coincidence signal generator 13 comprises coincidence circuits 13-1, 13-2 . . . 13-*k* and a NAND circuit 15 connected in common to the output terminals of these coincidence circuits 13-1, 13-2 . . . 13-*k*. Each of the coincidence circuits 13-1, 13-2 . . . 13-*k* has two input terminals, that is, first and second input terminals. The first input terminals thereof are connected to the output terminals 12-1, 12-2 . . . 12-*k* of the counter 12 and the second input terminals thereof are connected to the output terminals 8-1, 8-2 . . . 8-*k* of the envelope setting circuit 8. When the output signal from the counter 12 and the output signal from the envelope setting circuit 8 coincide with one another, a signal 1 is generated at the output side of each of the coincidence circuits 13-1, 13-2 . . . 13-*k* and this is changed into a signal 0 by the NAND circuit 15 and applied to the gate circuit 11.**

The gate circuit 11 is an AND circuit and operates in such a manner that pulses are allowed to pass therethrough by an output signal 1 received from the coincidence signal generator 13 and are prevented from passing by an output signal 0 from generator 13.

Circuit 16 is a distribution circuit whereby output pulses of the pulse generator circuit 9 are distributed either to an addition pulse output terminal **16*a* or a subtraction pulse output terminal 16*b* according to the digital signals of the musical-tone waveform setting circuit 4. Circuit 16 comprises three AND circuits 17, 18 and 19 each having two input terminals, and a single inverter 20. First input terminals of the AND circuits 17 and 18 are connected generally in common and are further connected to the first output terminal 4B of the musical-tone waveform setting circuit 4. Second input terminals thereof are interconnected through the inverter 20 and are connected in common to the other output terminal 4A of the musical-tone waveform setting circuit 4.**

The remaining AND circuit 19 is interposed in the circuit connected to the output terminal 4B and another input terminal thereof is connected to the output terminal of the circuit 11. The output terminal of the AND circuit 17 is the addition pulse output terminal **16*a* and the output terminal of the AND circuit 18 is the subtraction pulse output terminal 16*b***.

Circuit 22 denotes an up-down counter for the addition or subtraction of output pulses from the output terminals **16*a* and 16*b*. The result of such calculation is taken out as an output in terms of a binary-scale digital signal. Circuit 23 is a D-A converter for converting such a digital signal into an analogue signal and element 24** is an output terminal thereof. The operation of this invention apparatus will next be explained.

For the sake of convenience, reference will be made to a case in which each sampling portion of the envelope setting circuit 8 has six setting points, and six output terminals, (that is, six bits are provided). If an envelope such as shown in FIG. 3 is assumed, since the analogue amounts thereof at first, second . . . sampling points are 3, 6, 8, 8, 6 . . ., the setting points in each sampling portion are set as shown by the following table:

| ANALOGUE AMOUNT | SETTING POINT NO. 6 | 5 | 4 | 3 | 2 | 1 |
|---|---|---|---|---|---|---|
| 3 | 0 | 0 | 0 | 0 | 1 | 1 |
| 6 | 0 | 0 | 0 | 1 | 1 | 0 |
| 8 | 0 | 0 | 1 | 0 | 0 | 0 |
| 8 | 0 | 0 | 1 | 0 | 0 | 0 |
| 6 | 0 | 0 | 0 | 1 | 1 | 0 |
| . | . | . | . | . | . | . |
| . | . | . | . | . | . | . |

At the musical-tone waveform setting circuit 4, sampling according to a waveform such as shown in FIG. 2(C) is effected according to INCREASE, DECREASE or EQUAL as mentioned before.

By depression of a key (not shown) output pulses are taken out from the clock pulse generators 1 and 5 and the high-speed pulse generator 10. In response to the first order pulse generated in the order pulse generator 7, a digital signal (0,0,0,0,1,1) corresponding to the analogue amount of 3 is taken from the output terminals 8-1 . . . 8-6 of the envelope setting circuit 8 and is applied to the coincidence signal generator 13. Since, at this time, the digital signal at the output terminals 12-1 . . . 12-6 of the counter 12 is (0,0,0,0,0,0), the output terminal of the NAND circuit 15 of the coincidence signal generator 12 is 1. Accordingly, output pulses from the high-speed pulse generator 10 pass through the gate circuit 11 and are applied as an input to the counter 12. The counter 12 counts these pulses and, when three pulses are counted, the digital signal at the output terminals 12-1 . . . 12-6 becomes (0,0,0,0,1,1) which is in coincidence with the digital signal at the output terminals 8-1 . . . 8-6 of the envelope setting means 8. Consequently, a signal 1 is taken out from respective coincidence circuits (13-1) . . . (13-6) and the output of NAND circuit 15 becomes 0 (FIG. 4 (1)*c*) and the gate circuit 11 is closed. Thereby, output pulses of the high-speed pulse generator 10 are restrained from passing. The three pulses (FIG. 4 (1)*d*) passed through the gate circuit 11 during its open period are applied to the AND circuit 19 of the distribution circuit 16.

If it is now assumed that the musical-tone waveform setting circuit 4 is set as shown in FIGS. 2(A) and (B), the output signal of the output terminals 4A and 4B is "INCREASE" (that is (1,1) so that the three pulses passed through the gate circuit 11 pass through the AND circuit 19 and the AND circuit 17, whereby the addition pulse output terminal **16*a* has the three pulses applied thereto. Thus, these three pulses are added in order in the up-down counter 22 and taken out as a digital signal. This signal is then converted by the D-A converter 23 into an ascending three-small-step waveform as shown in FIG. 4 (1**) *e*.

If, then, the clock pulse generator 1 generates a second pulse as shown in FIG. 4 (1)*a*, a reset pulse (FIG. 4(1)*b*) obtained in the reset pulse generator 14 by use of a differential circuit and a diode is applied to the counter 12 so as to reset the same. Thereby, the output of the coincidence signal generator 13 becomes 1 and the gate circuit 11 allows three pulses to pass therethrough in almost the same manner as mentioned before. Since the signal obtained at the output terminals 4A and 4B of the musical-tone waveform setting means 4 by the second pulse of the clock pulse generator 1 is "INCREASE" (that is, (1,1) in almost the same manner as above, three pulses are applied to the up-down counter 22 from the addition pulse output terminal 16a through the AND circuits 19 and 17 and there is obtained a three-small-step waveform accumulatively added to the three foregoing pulses.

Next, upon occurrence of the third and the fourth pulses taken from the clock pulse generator 1, "INCREASE" signals are taken from the musical-tone waveform setting circuit 4 according to FIG. 2, so that a three-small-step form wave is obtained in two stages. Next, by the fifth pulse, an EQUAL signal (1,0) is generated, so that pulses generated by the pulse generating means 9 are restrained from passing by the AND circuit 19 and consequently are not applied to the up-down counter 22. Thus, as shown in FIG. 4 (1) *e*, the level of the fourth step by the fourth pulse remains as it is. At the sixth pulse, a DECREASE signal (0,1) is generated, so that three pulses are applied to the up-down counter 22 from the subtraction pulse output terminal 16*b* through the AND circuit 18, whereby a subtraction is effected and a descending of a three-small-step waveform as shown in FIG. 4(1)*e* is brought about. Thus, three pulses generated in order by the pulse generating circuit 9 are applied to the up-down counter 22 after being distributed depending on the kind of signal (i.e., "INCREASE", "DECREASE" and "EQUAL") provided by the musical-tone waveform setting circuit 4 so that addition or substraction may be carried out. Thus, a waveform as shown in FIG. 4(1)*e* which is similar to the derived musical-tone waveform can be generated repeatedly.

When, after the lapse of a predetermined length of time, the clock pulse generator 5 generates the second pulse, the analogue amount of six at the second sampling point on the envelope is taken out as a digital signal (0,0,0,1,1,0) by the second order pulse obtained through the order pulse generator 7, and this signal is applied to the coincidence signal generator 13. Thus, it is repeated that a signal as shown in FIG. 4 (2)*a* is taken from the coincidence signal generator 13 and six input pulses are counted at the counter means 12 as shown in FIG. 4 (2)*b*. The six pulses generated in order are distributed according to the output signals of the musical-tone waveform setting circuit 4 and the addition or the subtraction of all pulses is carried out at the up-down counter 22 and thereby a waveform similar to the desired musical-tone waveform and comprising a six-small-step waveform is repeatedly obtained.

Subsequently thereto, at the third pulse of the clock pulse generator 5, a waveform comprising air eight-small-step waveform resulting from addition or substraction can be obtained. At the fourth pulse, similarly, a waveform comprising an eight-small-step waveform is obtained. At the fifth pulses, a waveform comprising a six-small-step waveform is obtained, and so on. Consequently, throughout one envelope, a musical-tone signal as shown in FIg. 5 can be obtained.

Reference has been made to a case in which the sampling numbers of the musical tone waveform and the envelope are comparatively small, but it follows that a signal closer to the desired musical-tone signal can be obtained if the sampling numbers are increased.

Any desired envelope forming is made possible by properly setting each sampling portion of the envelope setting circuit and it is possible to form, for instance, a vibrato envelope by vibration damping.

When the apparatus of this invention is applied to an electronic musical instrument having keys, a number of circuits corresponding to the number of the keys are required to be provided. In this case, the clock pulse oscillator 5 and the high-speed pulse generator 10 can be used in common. Further, the oscillation frequency of the clock pulse oscillator 1 is required to be n times the frequency intended to be finally obtained.

Thus, according to this invention, a pulse signal, of which the pulse number corresponds to the digital signal value of the envelope setting circuit, is generated in order, and these signals are distributed either to an addition pulse output terminal or a subtracted pulse output terminal according to the output digital signal of INCREASE, DECREASE or EQUAL of the musical-tone waveform setting circuit. The output pulses thereof are added or subtracted in order by the up-down counter to obtain a musical-tone signal corresponding to the digital signals of the envelope, so that a musical-tone signal having any desired envelope can be obtained. The apparatus can be formed to be of IC type because the operation thereof is effected only by digital signals.

In the above, circuits 4 and 8 can be designed generally as shown in the form of matrix circuit 60 in FIG. 4 of U.S. Pat. No. 3,515,792.

What is claimed is:

1. A musical-tone signal forming apparatus for an electronic musical instrument comprising a musical-tone waveform setting means in which at least one cycle of a musical-tone waveform is subjected to sampling at n points and the amplitude thereof at each sampling point is compared with the amplitude at the preceding sampling point and an INCREASE, equal or DECREASE signal is generated as a digital signal to indicate the relationship determined, an envelope setting means in which an envelope of a musical tone is subjected to sampling at m points and the analogue amount at each sampling point is generated in order as a digital signal corresponding thereto, a pulse generating means whereby a pulse signal of which the pulse number corresponds to the digital signal value produced by the envelope setting means is repeatedly generated, a distribution means including addition and subtraction output terminals and in which output signals of the pulse generating means are distributed either to said addition output terminal or said subtraction output terminal according to the digital signals of the musical-tone waveform setting means, an up-down counter means in which output signals of the addition output terminal and the subtraction output terminal are respectively added or subtracted, and a D-A converter means in which digital signals generated in order from the up-down counter means are converted into analogue signals.

2. An apparatus as claimed in claim 1, comprising a clock pulse generator, an order pulse generator and a counter and wherein the musical-tone waveform setting means is connected at its input side through said order pulse generator and said counter to said clock pulse generator which generates clock pulse corresponding to a frequency of a musical scale tone.

3. An apparatus as claimed in claim 1 comprising a clock pulse generator, an order pulse generator and a counter and wherein the musical-tone waveform setting means is connected at its input side through said order pulse generator and said counter to said clock pulse generator which generates clock pulses corresponding to a frequency of a musical scale tone.

4. An apparatus as claimed in claim 2, wherein the pulse generating means comprises a high-speed pulse oscillator which generates a pulse signal of a frequency higher than the oscillation frequency of the clock pulse generator, a gate circuit, a counter means connected to the output terminal of the high-speed pulse oscillator through said gate circuit, a coincidence signal generator which generates a coincidence signal when a digital signal obtained at the output terminals of the envelope setting means are in coincidence with one another, and a reset pulse generator which generates a sharp pulse corresponding to the front edge of each clock pulse generated by the clock pulse generator, the output terminal of the reset pulse generator being connected to the reset terminal of the counter means and and output terminal of the coincidence signal generator being connected to a control terminal of the gate circuit.

5. An apparatus as claimed in claim 4, comprising an inverter and a first AND circuit and wherein the distribution means comprises second and third AND circuits, which have respectively two input terminals and are connected with one another at their input sides, through a inverter and said first AND circuit which has two input terminals and is interposed, via one input terminal and an output terminal, in one of two circuits connected between two output terminals of the musical-tone waveform setting means and the two input terminals of the second and third AND circuits, the other input terminal of said first AND circuit being connected to an output terminal of a gate circuit of the pulse generating means.

6. An apparatus as claimed in claim 4 wherein said coincidence signal generator includes an NAND gate producing an output coupled to the first said gate circuit and three coincidence circuits supplying inputs to said NAND gate and being coupled to said envelope setting means, said counter means including different output terminals collectively representing a count and respectively coupled to said three coincidence circuits.

* * * * *